US008783685B2

(12) United States Patent
Reinhard et al.

(10) Patent No.: US 8,783,685 B2
(45) Date of Patent: Jul. 22, 2014

(54) MACHINE FOR PROCESSING SHEETS WITH A PLURALITY OF MODULES

(71) Applicant: KBA-NotaSys SA, Lausanne (CH)

(72) Inventors: Gerald Josef Reinhard, Sulzfeld (DE); Volkmar Rolf Schwitzky, Wurzbrug (DE); Manfred Georg Stohr, Guntersleben (DE); Johannes Georg Schaede, Wurzburg (DE)

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 13/657,011

(22) Filed: Oct. 22, 2012

(65) Prior Publication Data

US 2013/0176356 A1 Jul. 11, 2013

Related U.S. Application Data

(62) Division of application No. 10/565,031, filed on Jan. 17, 2006, now Pat. No. 8,328,194.

(51) Int. Cl.

| | |
|---|---|
| ***B65H 5/04*** | (2006.01) |
| ***G07D 11/00*** | (2006.01) |
| ***B41J 29/393*** | (2006.01) |
| ***B41F 11/02*** | (2006.01) |

(52) U.S. Cl.

CPC ..... *B41J 29/393* (2013.01); *B41P 2217/11* (2013.01); *G07D 11/0081* (2013.01); *G07D 11/0051* (2013.01); *B41F 11/02* (2013.01)

USPC ..... 271/275; 101/216

(58) Field of Classification Search

USPC ..... 271/3.14, 4.01, 258.01, 258.02, 265.01, 271/275–277, 265.02; 358/490, 493; 101/230, 216, 232

See application file for complete search history.

(56) References Cited

U.S. PATENT DOCUMENTS

| | | | |
|---|---|---|---|
| 1,514,049 | A | 11/1924 | Ichida |
| 3,412,993 | A | 11/1968 | Giori |
| 3,782,543 | A | 1/1974 | Martelli et al. |
| 4,231,291 | A | 11/1980 | Davidson, Jr. |
| 4,296,326 | A | 10/1981 | Haslop |
| 4,299,325 | A | 11/1981 | Quinton et al. |
| 4,560,293 | A | 12/1985 | McCumber et al. |
| 4,677,910 | A | 7/1987 | Kuhfuss |
| 4,947,016 | A | 8/1990 | Puyplat |
| 5,406,884 | A | 4/1995 | Okuda et al. |
| 5,590,507 | A | 1/1997 | Wyssmann |
| 5,598,006 | A | 1/1997 | Stringa |
| 6,019,046 | A | 2/2000 | Rodi |

(Continued)

FOREIGN PATENT DOCUMENTS

| | | |
|---|---|---|
| CA | 2407810 | 11/2001 |
| CN | 1427774 | 11/2006 |

(Continued)

*Primary Examiner* — Thomas Morrison
(74) *Attorney, Agent, or Firm* — Krieg DeVault LLP; Clifford W. Browning

(57) ABSTRACT

A sheet-processing machine comprises a plurality of modules which are passed through one after the other by the sheets to be processed. The modules each have a sheet input interface and/or a sheet output interface, wherein, in at least one of the modules, the sheet input interface and/or the sheet output interface can optionally be coupled to sheet output interfaces and sheet input interfaces, respectively, of at least two other modules.

15 Claims, 7 Drawing Sheets

(56) References Cited

U.S. PATENT DOCUMENTS

Figure 1:
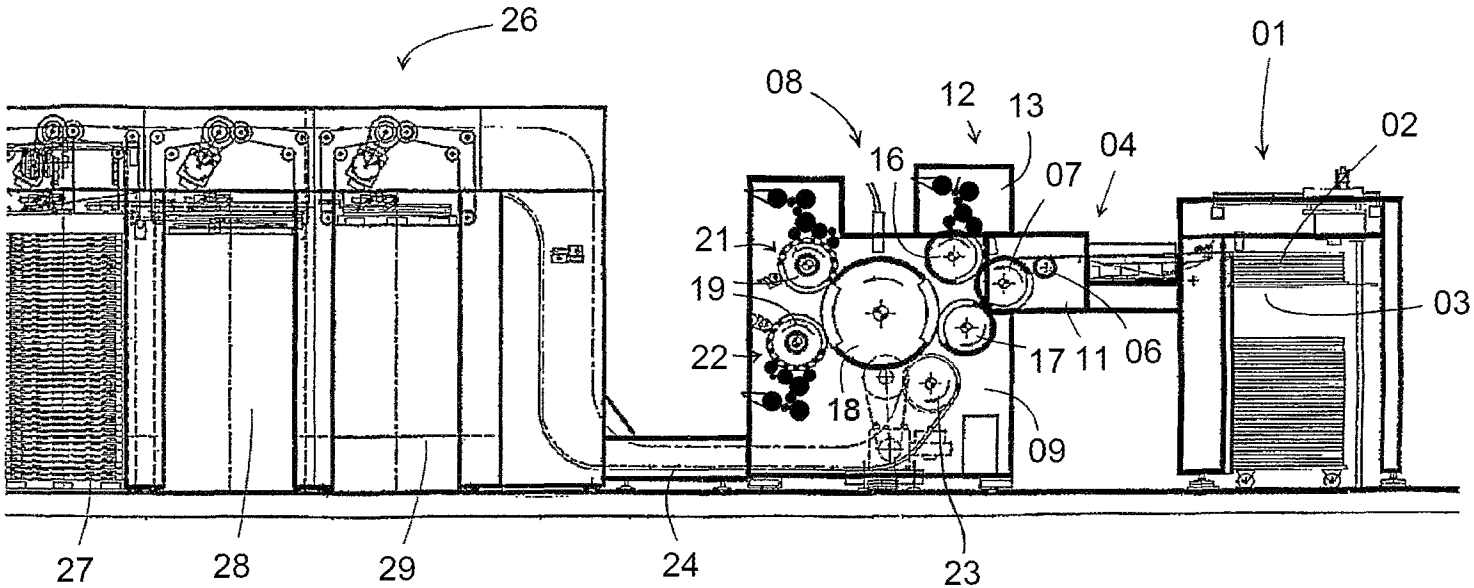

| | | | | |
|---|---|---|---|---|
| 6,104,890 | A | 8/2000 | Kim | |
| 6,166,366 | A | 12/2000 | Lewis et al. | |
| 6,840,721 | B2 | 1/2005 | Kaule et al. | |
| 6,867,423 | B2 | 3/2005 | Warner | |
| 6,883,429 | B2 * | 4/2005 | Kamoda | 101/480 |
| 2004/0026851 | A1 | 2/2004 | Schaede | |
| 2005/0052711 | A1 | 3/2005 | Schaede | |
| 2006/0249040 | A1 | 11/2006 | Giori et al. | |

FOREIGN PATENT DOCUMENTS

| | | | |
|---|---|---|---|
| DE | 1953542 | | 5/1971 |
| DE | 30 08 023 | | 3/1980 |
| DE | 4343616 | A1 | 6/1995 |
| DE | 19933304 | A | 1/2001 |
| DE | 19961880 | A1 | 3/2001 |
| FR | 2428287 | | 1/1980 |
| GB | 2 023 547 | A | 6/1978 |
| GB | 2 271 456 | A | 4/1994 |
| JP | 55082687 | A | 6/1980 |
| JP | 59-109365 | | 5/1984 |
| JP | 61-175552 | | 8/1986 |
| JP | 63-64748 | | 3/1988 |
| JP | 63-178139 | | 7/1988 |
| JP | 61-159160 | | 11/1988 |
| JP | 1-109504 | | 5/1991 |
| JP | 8-295004 | | 2/2000 |
| JP | 2000062134 | | 2/2000 |
| JP | 2000-85095 | | 3/2000 |
| JP | 2001058388 | | 3/2001 |
| RU | 94035753 | | 1/1997 |
| SU | 1389671 | | 7/1987 |
| WO | WO 97/48555 | | 12/1997 |
| WO | WO 01/85586 | A1 | 11/2001 |

* cited by examiner

MACHINE FOR PROCESSING SHEETS WITH A PLURALITY OF MODULES

The invention relates to a machine for processing sheets, and to modules in a sheet-processing machine.

The invention relates in particular to a sheet-processing machine comprising a plurality of modules which are passed through one after the other by the sheets to be processed, having a sheet feeder module for feeding the sheets to a downstream sheet-processing module, wherein the sheet input interface and the sheet output interface of at least one of the sheet-processing modules can optionally be coupled to sheet output interfaces and sheet input interfaces, respectively, of at least two other modules.

DE 199 33 304 and DE 199 61 880 describe sheet-processing machines which are composed of a feeder unit and a number of similar processing units.

In order to automatically process sheets quickly and in large numbers, said sheets must be individually lifted from a stack of sheets at the start of processing and placed back on a stack at the end of processing, provided that the sheets have remained intact during the processing. In order to keep low the number of operations of removing sheets from a stack and placing them back on a stack, it is desirable to combine as many sheet processing operations as possible in one device. The complexity and price of a sheet-processing device increase with the number of processing steps that can be carried out by said device. The user requirements of sheet-processing machines in terms of the method steps which the machine must be able to carry out differ on a case-by-case basis. This usually makes it necessary for a sheet-processing machine to be constructed individually for a plurality of specific intended use environments.

The object of the invention is to provide a sheet-processing machine and modules therefor, said machine being adapted to a plurality of specific intended use environments.

According to the invention, this object is achieved by a machine of the type mentioned above, in which the sheet-processing modules optionally comprise one or more of the following modules:

- an inspection module for monitoring the print quality of the sheets;
- a marking module for marking a sheet as usable or unusable depending on a monitoring result of the inspection module; and
- a numbering module for applying serial numbering to the sheets, and in that the modules are provided in such a way that the following machine assemblies can optionally be formed:

- a first assembly comprising a sheet feeder module and a numbering module connected in succession;
- a second assembly comprising a sheet feeder module, an inspection module and a numbering module connected in succession; and
- a third assembly comprising a sheet feeder module, an inspection module and a marking module connected in succession.

Some embodiments of the sheet-processing machine are those in which

- each of the interfaces has respective transport cylinders for accepting a sheet from an output transport cylinder of an upstream module or for passing a sheet to an input transport cylinder of a downstream module;
- a sheet transport path within a module, which has a sheet input interface that can be connected to a number of sheet output interfaces, is formed by an even number of transport cylinders;

- the output transport cylinder of an upstream module and the input transport cylinder of a downstream module have opposite directions of rotation;
- each of the modules has respective own side frame panels;
- the transport cylinders are fixed to the side frame panels;
- the side frame panels of the individual modules are fixed to one another;
- the modules have a cut-out in which the side frame panels of the modules can engage and be supported;
- columns can be provided for supporting the modules;
- one of the modules is an inspection module for monitoring the print quality of the sheets;
- one module is a marking module for marking a sheet as usable or unusable depending on a monitoring result of the inspection module;
- one of the modules is a numbering module for applying serial numbering to the sheets;
- the numbering module is arranged behind the inspection module in the conveying direction of the sheets, so as to apply the numbering only to those sheets which have passed the quality check carried out by the inspection module;
- a marking device is arranged in the numbering module;
- a transport module is provided;
- an expansion module is provided;
- an inking unit module is provided;
- inking unit rollers of the inking unit module are mounted in side frame panels which can be connected to the side frame panels of the other modules;
- the inking unit module can be arranged on other modules;
- one of the modules is a printing module;
- the printing module can be arranged on other modules and uses the cylinder of the respective module as form cylinder;
- the printing module uses a transport cylinder of a module adjacent to the module as counter-pressure cylinder;
- the circumference of the transport cylinders are of the same size;
- the form cylinder is the same size as the transport cylinders;
- the transport cylinders of the sheet output interface and the transport cylinders of the sheet input interface are arranged at the same height.

Some embodiments of the modules are those in which

- the module is an inspection module and comprises two transport cylinders which respectively transport the sheets with different sides facing outwards, and comprises inspection devices arranged at the two transport cylinders for inspecting the front and rear sides of the sheets, respectively;
- each of the inspection devices comprise a respective image sensor and a respective light source for inspection by reflection;
- the inspection devices comprise a UV light source and a light sensor for fluorescence produced by the UV light source;
- the inspection devices comprise a magnetic field sensor;
- a further transport cylinder is provided with a further inspection device;
- the inspection device comprises an image sensor and a light source for inspection by transmission;
- the module is a numbering module and comprises at least one numbering unit for printing a serial number on the sheets to be processed;
- two numbering units are arranged on a counter-pressure cylinder with two printing segments;
- a marking device is arranged upstream of a numbering unit;

a marking device is arranged on a counter-pressure cylinder of a numbering unit;

a marking device marks an edge region of a column and/or row in which the fault is located;

a marking device marks a column and outputs the row number in which the faulty printing is located;

the module comprises a marking device for applying a marking to sheets;

the module is a marking module and comprises a marking device for applying a marking to sheets;

the marking device is designed to apply the marking as unusable selectively to individual copies or in relation to individual copies on a sheet;

the marking device marks the edge region of a column and/or row in which the fault is located;

the marking device marks a column and outputs the row number in which the faulty printing is located;

the marking device comprises a plurality of print heads which are distributed uniformly in the direction transverse to the transport direction of the sheets;

the marking device is an inkjet printing mechanism;

one module is an inking unit and, in conjunction with other modules, forms a printing unit;

the inking unit is removably installed on the module;

the inking unit, in conjunction with a form cylinder of another module, forms a printing unit;

the transport cylinder of another module acts as counter-pressure cylinder;

it is a printing module;

it has a sheet input interface and a sheet output interface which are complementary to one another.

The sheet-processing machine thus carries out a method wherein, between two respective processing steps, a transfer step takes place between the modules provided for carrying out said processing steps, and wherein at least two of the transfer steps take place between identical pairs of interfaces of the modules. The processing steps comprise at least three of the following steps:

feeding the sheets, printing a constant motif on the sheets, checking the quality of the sheets, applying an unusable-marking to sheets of insufficient quality, applying a numbering to the sheets of sufficient quality, depositing the sheets.

One particular advantage of the machine is that the ability of the interfaces to be connected to one another in a flexible manner makes it possible to disconnect a module or a group of modules, the input of which is formed by one of the respective identical sheet input interfaces and the output of which is formed by one of the identical sheet output interfaces, from the machine and to join the sheet input and output interfaces of the remaining parts of the machine in order thus to create a machine with a reduced number of functions. Of course, the flexibility of the input and output interfaces also makes it possible to add additional modules or groups of modules to the machine if required. A machine with functions tailored precisely to a use environment can thus be built on a modular basis from a plurality of modules which can be placed in any desired order, without a high effort in terms of construction or specific adaptation of parts of the machine being necessary for this in each specific case.

Within such a module, the transport of sheets preferably takes place by means of transport cylinders, between which the sheets are transferred. The number of transport cylinders is preferably even, so that a transport cylinder of the sheet input interface of a module and a transport cylinder of the sheet output interface of the same module have opposite directions of rotation and thus the transport cylinder of the sheet output interface can cooperate with a transport cylinder of the sheet input interface of the subsequent module, which rotates in the same direction as that of the sheet input interface of said first module.

The modules are preferably formed with their own side frame panels, which can be fixed to one another in order to join the overall machine.

One module of such a sheet-processing machine may be for example an inspection module for monitoring the print quality of sheets being processed by the machine.

The monitoring result of the inspection module can be used to control a process of sorting the sheets into usable sheets and waste, this sorting process taking place at a sheet discharger of the machine. A marking module may also be provided as a further module, which marking module serves to mark a sheet as usable or unusable depending on the monitoring result of the inspection module.

Such a module may also be a printing module. Such a printing module is preferably further divided into a transport module, which serves to transport the sheets through a printing nip and may also be provided for further processing operations on the sheet, and a printing unit which can be placed onto the transport module in order to form a printing nip.

In one particularly space-saving configuration of the machine, the printing module uses a transport cylinder of a third module adjacent to the printing module as a counter-pressure cylinder for the printing operation. In particular, the transport cylinder of the sheet output interface of a module arranged upstream of the printing module may be used for this purpose.

A further module which may be contained in the machine is a numbering module for applying serial numbering to the sheets. Such a module is advantageous in particular when the machine is to be used to produce banknotes or other security papers, in which each copy has to be provided with a serial number. Such a numbering module is preferably arranged behind the inspection module so as, based on the detection results of the inspection module, to apply the numbering only to those sheets which have passed the quality check carried out by the inspection module.

An inspection module preferably comprises two transport cylinders which transport the sheets with different sides facing outwards, and first inspection devices arranged on the two cylinders for inspecting the front and rear sides of the sheets. Each of these inspection devices preferably comprises an image sensor and a light source for inspection by reflection for detecting the printed image which is illuminated by the reflected light source on a respective side of the sheet. This printed image can be compared with a desired image by an evaluation device, in order to identify the sheet as unusable in the event of differences between the desired image and the image printed on the sheet. As an alternative or in addition, there may be provided a UV light source and a light sensor which is suitable for detecting fluorescence produced by the UV light source on a sheet to be checked. Like the image sensor mentioned above, this light sensor can be of spatial resolution; it may even be identical to the image sensor. Alternatively, it may be a light sensor without spatial resolution, which provides only an indication of the intensity of the fluorescence in the part of the sheet illuminated by the UV light source. In order to detect special security features of banknotes, such as metal fibres incorporated in the sheets, the first inspection devices may also be equipped with a magnetic field sensor which reacts to changes in a magnetic field that are brought about by metal objects introduced into the field.

A further inspection device may also be provided which comprises an image sensor and a transmission light source for transmitting light through the sheet to be examined. Such a further inspection device allows for example inspections of watermarks or correct registration of front and back prints on the sheet with respect to one another.

Euro banknotes have on one side two respectively differently coloured prints of a serial number. In order to produce such prints with the machine, the numbering module thereof is preferably equipped with two numbering units, each of which produces one of the two prints. In order to simplify the numbering module, these are preferably arranged on the same counter-pressure cylinder. In order to be able to fit on the circumference thereof devices for accepting, holding and forwarding the sheets from and to an adjacent cylinder and the numbering units, said counter-pressure cylinder preferably has a circumference which corresponds to more than two sheet lengths and is equipped with two printing segments.

A marking device for applying a marking as unusable to sheets on the basis of the detection results from the inspection module can be added to the numbering module or can be provided as part of a separate module. As the marking device, use is preferably made of an inkjet printing mechanism since this can be arranged in a space-saving manner at almost any location and does not require any counter-pressure cylinder for producing the markings.

Examples of embodiments of the invention are shown in the drawings and are described in more detail below.

In the drawings:

Each of FIG. 1-7 show a schematic longitudinal section through a sheet-processing device according to the invention.

FIG. 1 shows a basic configuration of the machine. A first assembly of the machine is a sheet feeder 01. Sheets to be processed are fed to this sheet feeder 01 in the form of a respective stack 02. A lifting table 03 of the sheet feeder 01 lifts the stack 02 until the uppermost sheet thereof reaches a predefined height at which it can be lifted from the stack 02 by means of horizontally displaceable suction cups and can be displaced laterally in the direction of a conveyor belt table 04. For the sake of clarity, it should be mentioned that the conveyor belt table 4 forms part of the sheet feeder 01. The belts of the sheet table 04 convey each sheet until it comes into contact with a suction roll 06, to which the sheet adheres and the rotation of which is controlled in order to further convey the sheet to a transport cylinder 07 which forms the sheet output interface 07 of the sheet feeder, in such a way that the leading edge of the sheet can be gripped by grippers of the transport cylinder 07.

Arranged after the conveyor belt table 04 and the sheet feeder is a numbering module 08. The numbering module 08 comprises a plurality of cylinders 16; 17; 18; 19; 23, which, like the cylinders 06; 07 of the conveyor belt table 04, are rotatably held in side frame panels 09. The side frame panels 09 of the numbering module 08 have a cut-out in which the side frame panels 11 of the conveyor belt table 04 engage, so that the latter are supported by the side frame panels 09. The side frame panels 09; 11 are respectively fixed to one another.

A printing unit is composed of an inking unit 12 placed on the numbering module 08, said inking unit comprising a plurality of rolls which are suspended between side frame panels 13, and of a form cylinder 16 which is supplied with colour by the inking unit 12. The side frame panels 13 rest on the side frame panels 09; 11 and are fixed to the latter. The form cylinder 16 of the printing unit has an axis which lies at the height of the side frame panels 09 of the numbering module 08, and delimits a printing nip together with the transport cylinder 07. The numbering module 08 comprising the form cylinder 16 and the inking unit 12 can thus also be considered as a printing module. This printing module can be used to print any detail still missing onto sheets already comprising a preprinted basic pattern and which have been removed from the stack of the sheet feeder 01. This is particularly advantageous when producing banknotes, the basic pattern of which is printed in high numbers and in a manner which usually has remained completely unchanged for many years, but which has certain details which vary at relatively short time intervals, such as for example the signature of a Chairman of a central bank which issues the banknotes. The printing module is highly suitable for printing such a signature onto banknotes which have otherwise been preprinted.

After passing through the printing nip between the form cylinder 16 and the transport cylinder 07 of the sheet output interface 07 of the conveyor belt table 04, the sheets reach a transfer drum 17 and, via the latter, a counter-pressure cylinder 18 of the numbering module 08. Two numbering units 21; 22, each with an inking unit and a numbering cylinder 19 which is supplied with colour by the inking unit, which serve to print serial numbering onto the sheets guided through the device, are arranged on the counter-pressure cylinder 18. In order to be able to accommodate the numbering units 21; 22 at the circumference of the counter-pressure cylinder 18, the diameter of the latter is selected to be twice as great as that of the numbering cylinders 19, the transfer drum 17, the form cylinder 16 and the transport cylinder 07.

The two numbering units 21; 22 print respective identical serial numbers at two respective locations on each banknote printed on the sheets passing through. In principle, it would also be possible to produce two such prints using a single numbering unit 21; 22; however, the use of two numbering units 21; 22 makes it possible to print the numbering at the two locations in respective different colours or two positions in the circumferential direction.

The numbering cylinders 19 of the numbering units 21; 22 have on their circumference, distributed in the longitudinal and circumferential direction in a manner corresponding to the arrangement of the banknotes on the sheets, a plurality of number-printing units each with a plurality of rotatable digit wheels, which each have on their circumference all the printable digits which print a serial number in a manner dependent on the orientation of the individual digit wheels. During normal operation of the machine, the digit wheels are moved by one position after each printing operation, so that serial numbers are printed onto the sheets. A malfunction sensor is provided on each number-printing unit in order to detect whether the digit wheels have or have not moved between two printing operations carried out on successive sheets. If no movement is detected, a malfunction has occurred and the device is stopped.

Once the sheets on the counter-pressure cylinder 18 have passed both the numbering cylinders 19, they are picked up at a transfer cylinder 23 by a chain conveyor which feeds them via a connecting frame 24 to a sheet discharger 26. The sheet discharger 26 has a modular design with a plurality of stacks 27, 28; 29 on which the sheets can optionally be deposited. When one of the stacks, in this case the stack 27, is full, the sheet discharger 26 automatically switches to another stack 28, so that the full stack 27 can be moved away without having to interrupt the processing operation.

Figure 2:
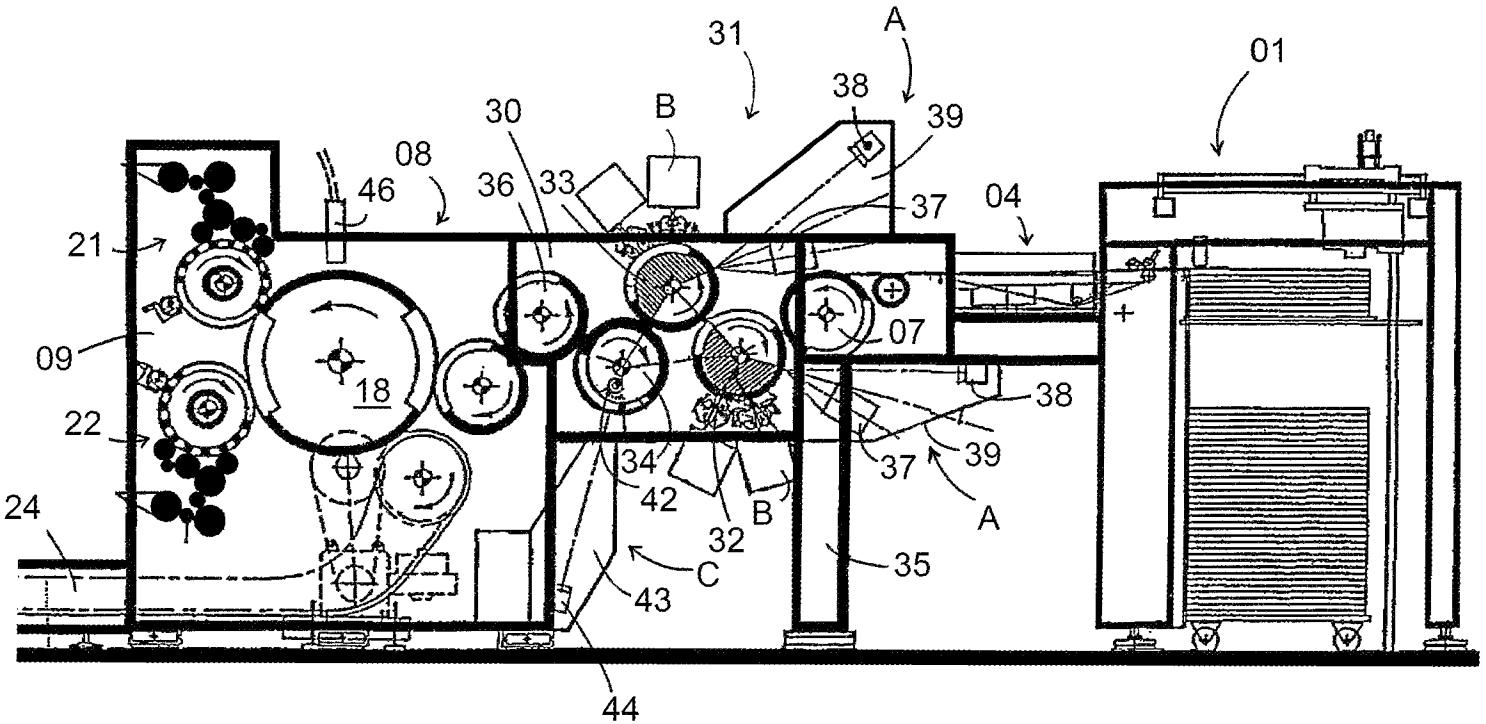

FIG. 2 shows a modified configuration of the processing device of FIG. 1. Parts of this configuration which correspond to those already described with reference to FIG. 1 bear the same references and are not described again. The sheet discharger 26 is identical to that shown in FIG. 1 and is not shown again in FIG. 2.

An inspection module 31 is in this case added between the conveyor belt table 04 and the numbering module 08. The inspection module 31 comprises four transport cylinders 32; 33; 34; 36 which are held between side frame panels 30. The side frame panels 30 of the inspection module 31 are respectively fixed at one side to those of the conveyor belt table 04 and at another side to those of the numbering module 08. Since neither the side frame panels 30 of the inspection module 31 nor those of the conveyor belt table 04 reach to the floor, they are supported by columns 35.

The transport cylinder 32 forms a sheet input interface 32 which accepts sheets from the transport cylinder 07 of the conveyor belt table 04. A first inspection device A arranged on the transport cylinder 32 comprises a light source 37 for illuminating an outer side of the sheet on the cylinder 32 and a camera 38 for scanning the region of the sheet surface that is illuminated by the light source 37, and also a housing 39 in which the light source 37 and the camera 38 are accommodated in order to shield them from ambient light. A computer (not shown in the figure) which is connected to the camera 38 compares the image of the sheet recorded by the camera with a desired printed image stored in electronic form, and decides whether the correspondence between the detected printed image and the desired printed image is good enough for the quality of the sheet to be deemed sufficient. Also arranged with the cylinder 32 is a UV inspection device B comprising a UV light source and a light sensor which is insensitive to the UV light of the light source but detects fluorescence of the sheet that is produced as a result. The intensity of the fluorescence is also compared with a desired value by means of the control unit (not shown) in order to assess the quality of the sheet.

After passing over the cylinder 32, the sheet is transferred to the subsequent transport cylinder 33. On this transport cylinder 33, that side of the sheet which faced the cylinder 32 now faces outwards. The same inspection devices A; B which are arranged on the cylinder 32 are also provided on the cylinder 33, so as to be able to check the quality of both sides of the sheet in the same way.

After passing over the cylinder 33, the sheet reaches the cylinder 34, within the transparent casing of which a light source 42 is arranged. A camera 44 which is once again accommodated in a housing 43 that is shielded from scattered light scans the region of the sheet which is illuminated by the light source 42, and the control unit also compares the image supplied by this camera 44 with a desired image. The transmitted light inspection device C formed by the light source 42, the housing 43 and the camera 44 permits the detection of registration errors between the prints on the front and rear sides of the sheets.

A magnetic field sensor M, which may be formed for example by a permanent magnet or an electromagnet and a Hall sensor, can be arranged on any transport cylinder 32; 33; 34; 36 of the inspection module 31. It allows the detection of metal fibres or other metallic elements which are incorporated as a security feature in many modern banknotes.

The last transport cylinder 36 of the inspection module 31 forms the sheet output interface 36 thereof to the subsequent numbering module 08. The cylinder 36 is arranged at the same height as the transport cylinder 07 which forms the sheet output interface 07 of the conveyor belt table 04. Moreover, the shape of the side frame panels 30 which hold the cylinders 32; 33; 34; 36 of the inspection module 31 is matched in the region facing the numbering module 08 to the shape of the side frame panels 09, so that it is possible to remove the inspection module 31 and attach the conveyor belt table 04 directly to the numbering module 08 in order thus to obtain the configuration shown in FIG. 1 or to convert the machine shown in FIG. 1 into the machine shown in FIG. 2 by subsequently adding the inspection module 31 between the conveyor belt table 04 and the numbering module 08 and removing the inking unit 12 and the form cylinder 16.

As a sheet passes through the various inspection devices A; B; C of the inspection module 31 and then is transported into the numbering module 08 to the counter-pressure cylinder 18, the computer evaluates the results of the various inspection devices A; B; C and decides whether the quality of the sheet or of the individual banknotes printed on the sheet is sufficient. If it is, the sheet passes through the two numbering units 21; 22, in which the individual banknotes are numbered, and is further conveyed via the connecting frame 24 (FIG. 1) to the sheet discharger 26 (not shown in FIG. 2). The latter is actuated by the control unit so as to discharge the sheets onto one of the two stacks 27 or 28 provided for usable sheets.

If the computer ascertains that the quality of a sheet or of an individual banknote on a sheet is insufficient, it actuates a marking device 46 which is arranged on the counter-pressure cylinder 18. The marking device 46 comprises a number of inkjet spray heads, each of which is directed towards a column of banknotes printed on the sheets and can be actuated by the computer to spray a marking onto a banknote deemed to be of insufficient quality at the time at which said banknote passes in front of the marking device 46. It is also conceivable to actuate the spray heads of the marking device 46 respectively at a moment at which a non-printed front or rear edge of a sheet deemed to be faulty passes through in front of the marking device 46, in order thus to mark a respective column on the sheet which contains a faulty banknote. The fault is in this way not hidden by the marking and can be examined by maintenance staff. In this variant, it may be advantageous to provide an additional spray head in the marking device 46 in order thus to place a marking on a non-printed side edge of the sheet at the same level as a row which contains the faulty banknote, so that the banknote deemed to be faulty, which is located at the point of intersection of the marked row and column, can be immediately identified by an observer.

If the computer detects that a sheet contains a faulty banknote, it also controls the numbering units 21; 22 so that these allow the sheets to pass without printing any numbers thereon. Consequently, the numbering units 21; 22 do not move their numbers as the faulty sheet passes through, so that a subsequent, fault-free sheet is respectively allocated numbers which directly follow on from those of a previously numbered sheet. The computer also controls the sheet discharger 26 so as to make the latter discharge the non-numbered sheet onto the stack 29 provided for waste in this configuration. The sheets deposited on the stacks 27; 28 for usable sheets are thus continuously numbered in any case, so that they can then be cut into individual banknotes and the banknotes can be combined into continuously numbered packs and sealed, without any manual corrective intervention being necessary.

Figure 3:
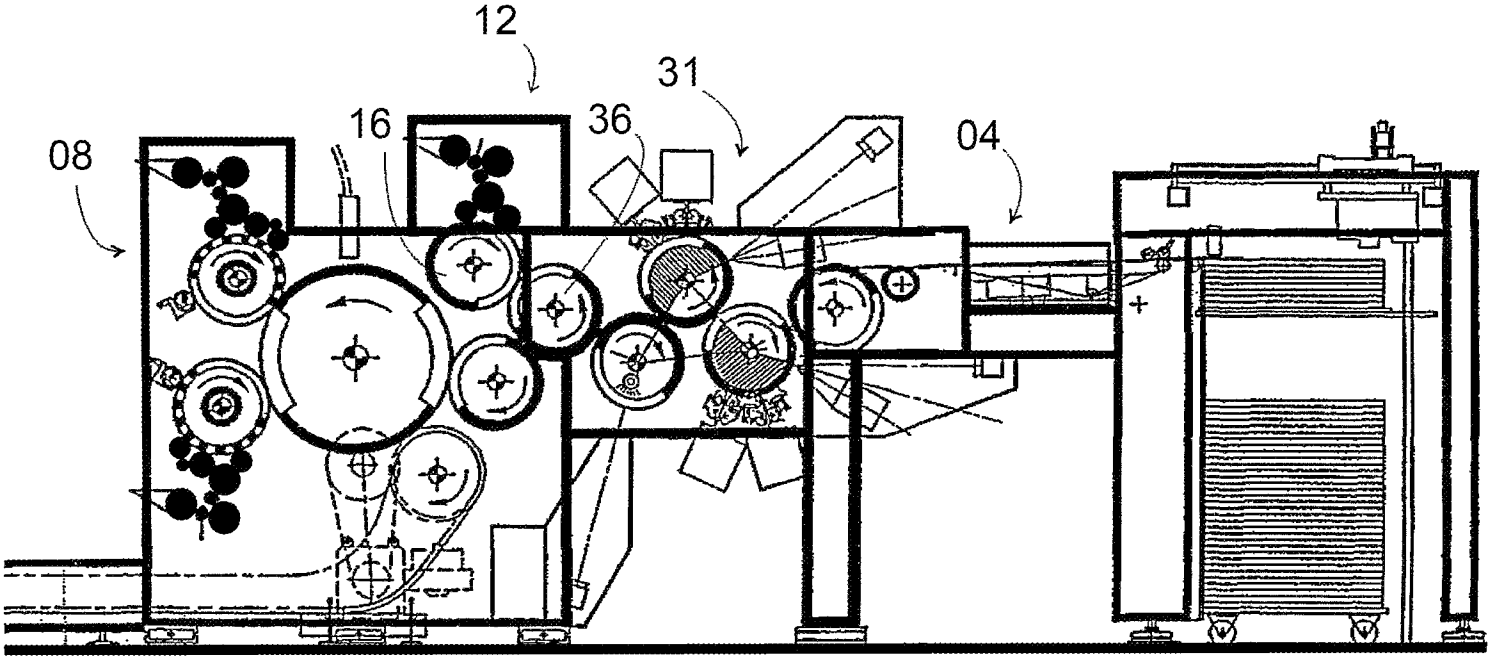

As shown in FIG. 3, the printing unit consisting of inking unit 12 and form cylinder 16 may of course also be added to the numbering module 08 if the inspection module 31 is inserted between the numbering module 08 and the conveyor belt table 04. In this case, the transport cylinder 36 of the inspection module 31 cooperates as counter-pressure cylinder 36 with the form cylinder 16 of the printing unit.

Figure 4:
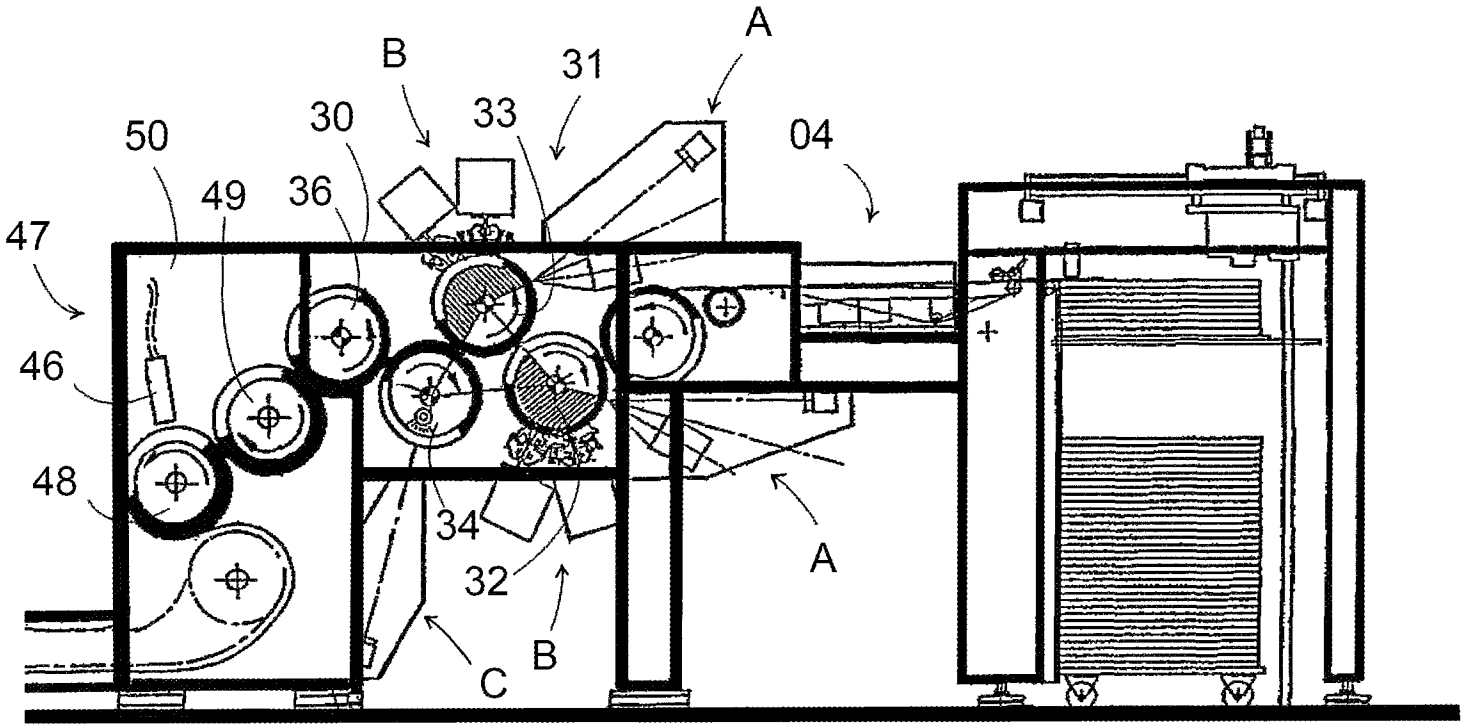

In the simplified modification shown in FIG. 4, the numbering module 08 is replaced by a marking module 47. This marking module 47 has as sheet input interface 49 a transfer cylinder 49 which is identical to the cylinder 17 of the numbering module 08 and is arranged at the same position as the latter. The transfer cylinder 49 passes the sheets to a transport cylinder 48 which, unlike the counter-pressure cylinder 18, has the same diameter as the cylinders 17; 32; 33; 34; 36, etc. The marking device 46 described with reference to FIG. 2 is arranged on this transport cylinder 48 at a suitable position. The mode of operation of the marking device 46 is the same as that described with reference to FIG. 2; in this case, too, sheets marked as unusable by means of a marking are discarded onto the waste stack 29 by the sheet discharger 26.

Figure 5:
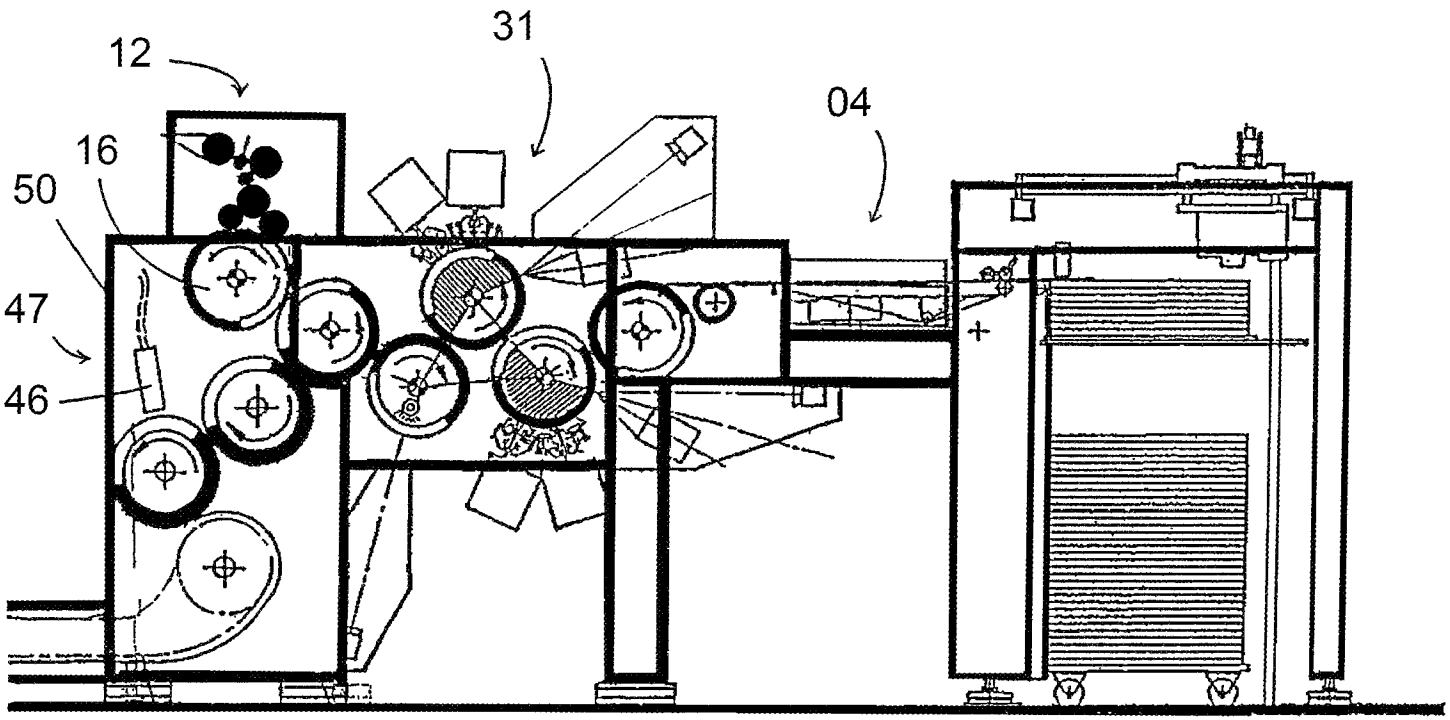

As shown in FIG. 5, the printing unit can be mounted on the marking module 47 in the same way as on the numbering module 08.

Figure 6:
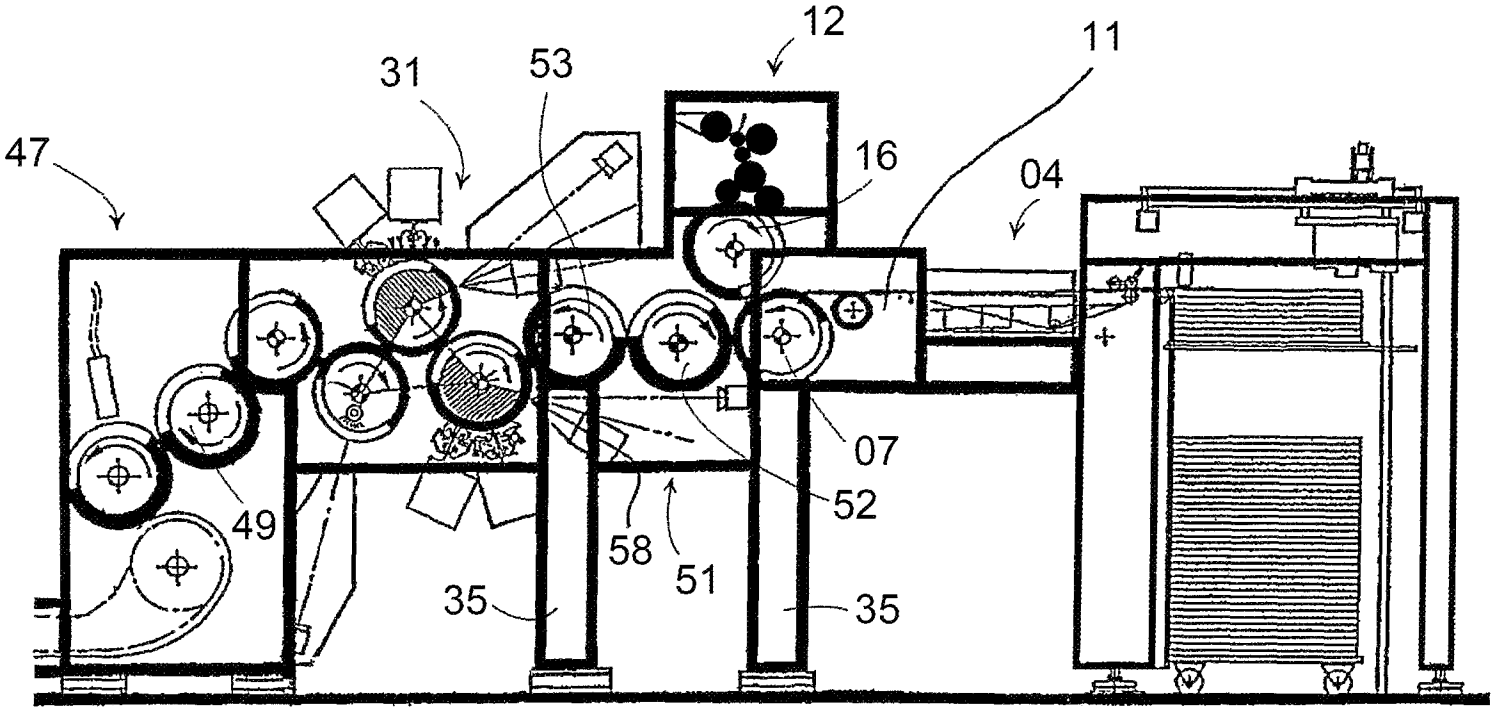

In the configurations of FIGS. 3 and 5, each of the sheets passes through the inspection module 31 before the printing unit, so that the quality of the print produced by the latter can no longer be checked by the inspection module 31. As shown in FIG. 6, this problem can be eliminated by adding a transport module 51 between the conveyor belt table 04 and the inspection module 31, which transport module essentially has the function of serving as a carrier for the printing unit. The transport module 51 contains two transport cylinders 52, 53, which respectively form the sheet input interface 52 and the sheet output interface 53 of the module 51. The purpose thereof is essentially only to convey the sheets between the conveyor belt table 04 and the inspection module 31 over a distance which is necessary in order to be able to accommodate the printing unit between the conveyor belt table 04 and the inspection module 31. Like in the configuration of FIG. 1, the form cylinder 16 of the printing unit cooperates with the transport cylinder 07 of the conveyor belt table 04.

Figure 7:
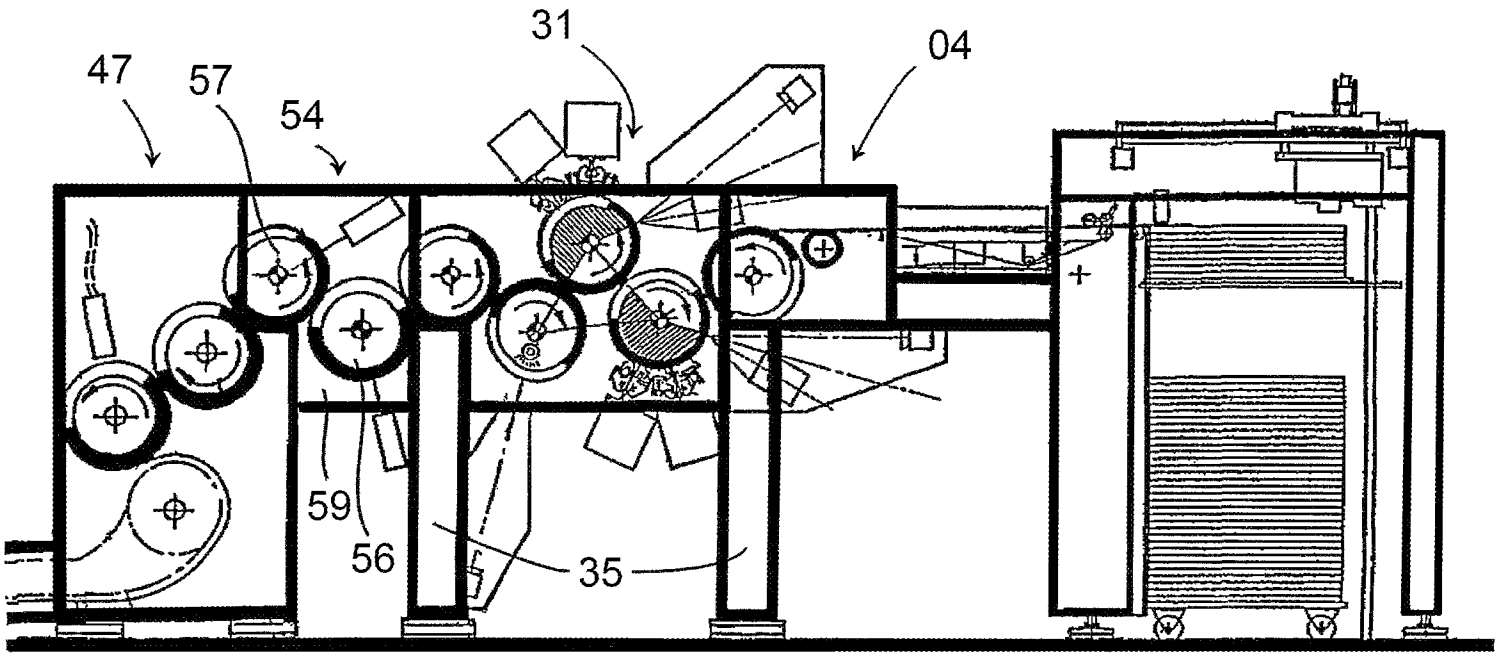

FIG. 7 shows a further configuration in which an expansion module 54 comprising two transport cylinders 56; 57 is added between the inspection module 31 and the marking module 47. The expansion module 54 can serve as a carrier for any further functional groups for carrying out processing steps on the sheets. It may for example serve as a carrier for further inspection devices for which there is no space on the inspection module 31, as a carrier for a printing unit, for laser marking devices, etc. It would also be conceivable to form the inspection module 31 from two expansion modules, wherein reflected light inspection devices A could be fitted on one of these and the transmitted light inspection device C could be fitted on the second of said expansion modules.

LIST OF REFERENCES

01 sheet feeder
02 stack
03 lifting table
04 module, conveyor belt table
05 -
06 suction roll
07 transport cylinder, sheet output interface
08 module, numbering module
09 side frame panels of 08
10 -
11 side frame panels of 04
12 inking unit
13 side frame panels of 12
14 -
15 -
16 cylinder, form cylinder
17 cylinder, transfer cylinder, transfer drum, sheet input interface
18 cylinder, counter-pressure cylinder
19 cylinder, numbering cylinder
20 -
21 numbering unit
22 numbering unit
23 cylinder, transfer drum
24 connecting frame
25 -
26 sheet discharger
27 stack
28 stack
29 stack, waste stack
30 side frame panels of 31
31 module, inspection module
32 cylinder, transport cylinder, sheet input interface
33 cylinder, transport cylinder
34 cylinder, transport cylinder
35 column
36 cylinder, transport cylinder, sheet output interface
37 light source
38 camera
39 housing
40 -
41 -
42 light source
43 housing
44 camera
45 -
46 marking device
47 module, marking module
48 transport cylinder
49 transfer cylinder, transport cylinder, sheet input interface
50 side frame panel of 47
51 module, transport module
52 transport cylinder, sheet input interface
53 transport cylinder, sheet output interface
54 module, expansion module
55 -
56 transport cylinder, sheet input interface
57 transport cylinder, sheet output interface
58 side frame panel
59 side frame panel
A inspection device, first
B inspection device, UV
C inspection device, transmitted light

The invention claimed is:

1. Sheet-processing machine for the production of banknotes or like security papers, comprising a plurality of sheet-processing modules coupled one after the other for processing of printed sheets each comprising a plurality of printed copies arranged in columns and rows, the sheet-processing machine comprising:

a sheet feeder module with a sheet feeder for feeding individual printed sheets;

an inspection module for monitoring the print quality of the printed sheets, which inspection module has a sheet input interface coupled to a sheet output interface of the sheet feeder module; and a numbering module for applying serial numbering to the printed sheets, which numbering module has a sheet input interface coupled to a sheet output interface of the inspection module, a transport module, wherein the sheet feeder module, the inspection module and the numbering module are designed in such a way that the inspection module can be decoupled from the sheet feeder module and from the numbering module and that the sheet input interface of the numbering module can be coupled directly to the sheet output interface of the sheet feeder module, wherein the sheet feeder module, the inspection module and the transport module are designed in such a way that the inspection module can be decoupled from the sheet feeder module and that the transport module can be coupled directly between a sheet input interface of the inspection module and the sheet output interface of the sheet feeder module.

2. Sheet-processing machine according to claim 1, wherein an inking unit module is provided which, in conjunction with the transport module, forms a printing module.

3. Sheet-processing machine according to claim 2, wherein a form cylinder is provided in the transport module for cooperation with the inking unit module to form the printing module.

4. Sheet-processing machine according to claim 3, wherein the printing module uses an output transport cylinder of the sheet feeder module upstream of the transport module as counter-pressure cylinder for the form cylinder.

5. Sheet-processing machine for the production of banknotes or like security papers, comprising a plurality of sheet-processing modules coupled one after the other for processing of printed sheets each comprising a plurality of printed copies arranged in columns and rows, the sheet-processing machine comprising:

a sheet feeder module with a sheet feeder for feeding individual printed sheets;

an inspection module for monitoring the print quality of the printed sheets, which inspection module has a sheet input interface coupled to a sheet output interface of the sheet feeder module; and a numbering module for applying serial numbering to the printed sheets or a marking module for marking a sheet as usable or unusable depending on a monitoring result of the inspection module, a transport module, wherein the sheet feeder module, the inspection module, the numbering module and the marking module are designed in such a way that a sheet output interface of the inspection module can be coupled directly to a sheet input interface of the numbering module or to a sheet input interface of the marking module, wherein the sheet feeder module, the inspection module and the transport module are designed in such a way that the inspection module can be decoupled from the sheet feeder module and that the transport module can be coupled directly between a sheet input interface of the inspection module and the sheet output interface of the sheet feeder module.

6. Sheet-processing machine according to claim 5, wherein an inking unit module is provided which, in conjunction with the transport module, forms a printing module.

7. Sheet-processing machine according to claim 6, wherein a form cylinder is provided in the transport module for cooperation with the inking unit module to form the printing module.

8. Sheet-processing machine according to claim 7, wherein the printing module uses an output transport cylinder of the sheet feeder module upstream of the transport module as counter-pressure cylinder for the form cylinder.

9. Sheet-processing machine for the production of banknotes or like security papers, comprising a plurality of sheet-processing modules coupled one after the other for processing of printed sheets each comprising a plurality of printed copies arranged in columns and rows, the sheet-processing machine comprising:

a sheet feeder module with a sheet feeder for feeding individual printed sheets;

an inspection module for monitoring the print quality of the printed sheets, which inspection module has a sheet input interface coupled to a sheet output interface of the sheet feeder module; and a numbering module for applying serial numbering to the printed sheets, which numbering module has a sheet input interface coupled to a sheet output interface of the inspection module, wherein the sheet feeder module, the inspection module and the numbering module are designed in such a way that the inspection module can be decoupled from the sheet feeder module and from the numbering module and that the sheet input interface of the numbering module can be coupled directly to the sheet output interface of the sheet feeder module, wherein the sheet output interfaces of the sheet feeder module and of the inspection module each comprise an output transport cylinder for transferring the printed sheets, wherein the sheet input interfaces of the inspection module and of the numbering module each comprise an input transport cylinder for receiving the printed sheets, and wherein the output transport cylinders of the sheet feeder module and of the inspection module are located at a same height.

10. Sheet-processing machine according to claim 9, wherein the output transport cylinders and input transport cylinders all have a same size.

11. Sheet-processing machine for the production of banknotes or like security papers, comprising a plurality of sheet-processing modules coupled one after the other for processing of printed sheets each comprising a plurality of printed copies arranged in columns and rows, the sheet-processing machine comprising:

a sheet feeder module with a sheet feeder for feeding individual printed sheets;

an inspection module for monitoring the print quality of the printed sheets, which inspection module has a sheet input interface coupled to a sheet output interface of the sheet feeder module; and a numbering module for applying serial numbering to the printed sheets or a marking module for marking a sheet as usable or unusable depending on a monitoring result of the inspection module, wherein the sheet feeder module, the inspection module, the numbering module and the marking module are designed in such a way that a sheet output interface of the inspection module can be coupled directly to a sheet input interface of the numbering module or to a sheet input interface of the marking module, wherein the sheet output interfaces of the sheet feeder module and of the inspection module each comprise an output transport cylinder for transferring the printed sheets, wherein the sheet input interfaces of the inspection module, of the numbering module and of the marking module each comprise an input transport cylinder for receiving the printed sheet, wherein the output transport cylinders of the sheet feeder module and of the inspection module are located at a same first height and wherein the input transport cylinders of the numbering module and of the marking module are located at a same second height.

12. Sheet-processing machine according to claim 11, wherein the output transport cylinders and input transport cylinders all have a same size.

13. Sheet-processing machine for the production of banknotes or like security papers, comprising a plurality of sheet-processing modules coupled one after the other for processing of printed sheets each comprising a plurality of printed copies arranged in columns and rows, the sheet-processing machine comprising:

a sheet feeder module with a sheet feeder for feeding individual printed sheets;

an inspection module for monitoring the print quality of the printed sheets, which inspection module has a sheet input interface coupled to a sheet output interface of the sheet feeder module; and a numbering module for applying serial numbering to the printed sheets, which numbering module has a sheet input interface coupled to a sheet output interface of the inspection module, wherein the sheet feeder module, the inspection module and the numbering module are designed in such a way that the inspection module can be decoupled from the sheet feeder module and from the numbering module and that the sheet input interface of the numbering module can be coupled directly to the sheet output interface of the sheet feeder module, wherein the sheet feeder module, inspection module and numbering module each have their own respective side frame panels, wherein the numbering module has a cut-out for engagement and support of the side frame panels of the inspection module or of the sheet feeder module.

14. Sheet-processing machine for the production of banknotes or like security papers, comprising a plurality of sheet-processing modules coupled one after the other for processing of printed sheets each comprising a plurality of printed copies arranged in columns and rows, the sheet-processing machine comprising:

a sheet feeder module with a sheet feeder for feeding individual printed sheets;

an inspection module for monitoring the print quality of the printed sheets, which inspection module has a sheet input interface coupled to a sheet output interface of the sheet feeder module; and a numbering module for applying serial numbering to the printed sheets or a marking module for marking a sheet as usable or unusable depending on a monitoring result of the inspection module, wherein the sheet feeder module, the inspection module, the numbering module and the marking module are designed in such a way that a sheet output interface of the inspection module can be coupled directly to a sheet input interface of the numbering module or to a sheet input interface of the marking module, wherein the sheet feeder module, inspection module, numbering module and marking module each have their own respective side frame panels, wherein the numbering module and marking module each have a cut-out for engagement and support of the side frame panels of the inspection module.

15. Sheet-processing machine for the production of banknotes or like security papers, comprising a plurality of sheet-processing modules coupled one after the other for processing of printed sheets each comprising a plurality of printed copies arranged in columns and rows, the sheet-processing machine comprising:

a sheet feeder module with a sheet feeder for feeding individual printed sheets;

an inspection module for monitoring the print quality of the printed sheets, which inspection module has a sheet input interface coupled to a sheet output interface of the sheet feeder module; and a numbering module for applying serial numbering to the printed sheets, which numbering module has a sheet input interface coupled to a sheet output interface of the inspection module, wherein the sheet feeder module, the inspection module and the numbering module are designed in such a way that the inspection module can be decoupled from the sheet feeder module and from the numbering module and that the sheet input interface of the numbering module can be coupled directly to the sheet output interface of the sheet feeder module, wherein the inspection module comprises an even number of transport cylinders for transporting the printed sheets through the inspection module, wherein a first transport cylinder amongst the transport cylinders of the inspection module transports the printed sheets with a front side facing a first inspection device, which first inspection device inspects the front side of the printed sheets while being transported by the first transport cylinder and supported against a circumference of the first transport cylinder, wherein a second transport cylinder amongst the transport cylinders of the inspection module transports the printed sheets with a rear side facing a second inspection device, which second inspection device inspects the rear side of the printed sheets while being transported by the second transport cylinder and supported against a circumference of the second transport cylinder, and wherein a third transport cylinder amongst the transport cylinders of the inspection module has a transparent casing and transports the printed sheets in front of a third inspection device which inspects light-transmitting capacity of the printed sheets.

* * * * *

UNITED STATES PATENT AND TRADEMARK OFFICE

CERTIFICATE OF CORRECTION

PATENT NO. : 8,783,685 B2
APPLICATION NO. : 13/657011
DATED : July 22, 2014
INVENTOR(S) : Gerald Josef Reinhard et al.

It is certified that error appears in the above-identified patent and that said Letters Patent is hereby corrected as shown below:

On Title Page, (73) Assignee, please delete "KBA-Giori S.A." and insert --KBA-NotaSys SA--.

Signed and Sealed this
Thirteenth Day of October, 2015

Michelle K. Lee

Michelle K. Lee
*Director of the United States Patent and Trademark Office*